US008621817B1

(12) United States Patent
Kreizinger

(10) Patent No.: US 8,621,817 B1
(45) Date of Patent: Jan. 7, 2014

(54) VERTICAL VIBRATING SCREED

(76) Inventor: Kenneth Robert Kreizinger, Fort Lauderdale, FL (US)

( * ) Notice: Subject to any disclaimer, the term of this patent is extended or adjusted under 35 U.S.C. 154(b) by 0 days.

(21) Appl. No.: 13/373,816

(22) Filed: Dec. 1, 2011

Related U.S. Application Data

(60) Provisional application No. 61/458,934, filed on Dec. 3, 2010, provisional application No. 61/461,436, filed on Jan. 18, 2011.

(51) Int. Cl.
*E04B 1/00* (2006.01)

(52) U.S. Cl.
USPC ..... 52/742.14; 52/742.1; 366/31; 366/32; 366/114; 264/71

(58) Field of Classification Search
USPC ..... 52/742.1, 742.14; 366/31, 32, 114; 264/71
See application file for complete search history.

(56) References Cited

U.S. PATENT DOCUMENTS

| | | | | | |
|---|---|---|---|---|---|
| 2,187,223 | A | | 1/1940 | Cory | |
| 2,253,730 | A | | 8/1941 | Seailles | |
| 2,346,378 | A | | 4/1944 | Jackson | |
| 2,516,318 | A | * | 7/1950 | Hawes | 425/63 |
| 3,039,164 | A | | 6/1962 | Kemeny et al. | |
| 3,176,371 | A | * | 4/1965 | Patchen | 425/253 |
| 3,497,579 | A | * | 2/1970 | Barron | 264/33 |
| 3,509,606 | A | | 5/1970 | Fisher | |
| 3,510,098 | A | | 5/1970 | Fox | |
| 3,705,776 | A | * | 12/1972 | Johansson | 425/65 |
| 3,754,066 | A | * | 8/1973 | Black | 264/71 |
| 3,936,211 | A | | 2/1976 | Miller et al. | |
| 3,957,405 | A | | 5/1976 | Goughnour | |
| 4,014,633 | A | | 3/1977 | Goughnour | |
| 4,076,474 | A | | 2/1978 | Catenacci | |
| 4,076,778 | A | | 2/1978 | Whitting | |
| 4,084,928 | A | | 4/1978 | Petersik | |
| 4,128,610 | A | | 12/1978 | Ahlgren | |
| 4,152,382 | A | * | 5/1979 | Catenacci | 264/33 |
| 4,253,810 | A | | 3/1981 | Bezhanov et al. | |
| 4,314,798 | A | * | 2/1982 | Pettersson | 425/63 |
| 4,320,075 | A | | 3/1982 | Nielson | |
| 4,359,296 | A | * | 11/1982 | Cronkhite | 404/114 |
| 4,653,957 | A | | 3/1987 | Smith et al. | |
| 4,761,126 | A | * | 8/1988 | del Valle | 425/62 |
| 4,775,313 | A | * | 10/1988 | DiIoia | 425/458 |
| 5,198,235 | A | * | 3/1993 | Reichstein et al. | 425/62 |
| 5,387,051 | A | * | 2/1995 | Valente | 404/84.05 |
| 5,527,129 | A | | 6/1996 | McKinnon | |
| 5,533,888 | A | | 7/1996 | Belarde | |
| 5,554,392 | A | * | 9/1996 | Gray | 425/64 |
| 5,558,823 | A | * | 9/1996 | Gray | 264/33 |

(Continued)

*Primary Examiner* — Basil Katcheves
*Assistant Examiner* — Joshua Ihezie

(57) ABSTRACT

This invention discloses a method of building concrete walls, columns and other vertical or sloped structures using a vertically oriented vibrating screed and utilization of the thixotropic properties of wet concrete. The vertical screed is a simple, inexpensive and highly flexible apparatus that may be used for a wide variety of applications that involve the applying of cementicious material in the construction of a vertical structure. By using highly thixotropic concrete, the vertical screed is able to place concrete and other cementicious materials in a vertical plane much like concrete is placed with vibrating screeds in the horizontal plane. The vertical screed's applications range from applying a thin cementicious coating to placing concrete in a vertical plane to construct a wall or column. The various configurations of the vertical screed range from a small hand held device to a much larger mechanically controlled apparatus.

19 Claims, 8 Drawing Sheets

(56) References Cited

U.S. PATENT DOCUMENTS

| | | | | |
|---|---|---|---|---|
| 5,616,291 | A * | 4/1997 | Belarde | 264/34 |
| 5,732,753 | A * | 3/1998 | Danzi et al. | 141/340 |
| 5,857,803 | A | 1/1999 | Davis et al. | |
| 5,997,270 | A | 12/1999 | LaBonte | |
| 6,013,972 | A | 1/2000 | Face, Jr. et al. | |
| 6,047,518 | A * | 4/2000 | Lytle | 52/742.13 |
| 6,223,384 | B1 | 5/2001 | Kuhlen | |
| 6,430,824 | B1 * | 8/2002 | Smith | 33/286 |
| 6,460,581 | B1 * | 10/2002 | Marshall et al. | 141/337 |
| 6,555,040 | B1 * | 4/2003 | Lienau | 264/109 |
| 6,668,417 | B1 * | 12/2003 | Slattery | 15/235.4 |
| 6,770,228 | B2 | 8/2004 | Rock | |
| 6,926,851 | B2 * | 8/2005 | Colavito et al. | 264/33 |
| 6,976,805 | B2 | 12/2005 | Quenzi et al. | |
| 7,004,737 | B2 | 2/2006 | Russell | |
| 7,156,577 | B1 | 1/2007 | Rozinski | |
| 7,204,659 | B2 * | 4/2007 | Schmitt et al. | 404/118 |
| 7,465,121 | B1 | 12/2008 | Hendricks et al. | |
| 7,641,461 | B2 * | 1/2010 | Khoshnevis | 425/60 |
| 7,980,843 | B2 * | 7/2011 | Zimmerman et al. | 425/147 |
| 2002/0106243 | A1 * | 8/2002 | Rahn et al. | 404/96 |
| 2005/0036837 | A1 | 2/2005 | Marshall | |
| 2005/0100407 | A1 * | 5/2005 | Sina | 404/114 |
| 2005/0276156 | A1 * | 12/2005 | Elsten | 366/117 |
| 2006/0133896 | A1 * | 6/2006 | Schmitt et al. | 404/118 |
| 2007/0082080 | A1 | 4/2007 | Sandqvist | |
| 2007/0201302 | A1 * | 8/2007 | Lindley | 366/123 |
| 2007/0292208 | A1 * | 12/2007 | Lutz et al. | 404/114 |
| 2008/0050177 | A1 | 2/2008 | Sager | |
| 2009/0053345 | A1 | 2/2009 | Martins et al. | |
| 2010/0139196 | A1 | 6/2010 | Healy | |
| 2010/0239368 | A1 * | 9/2010 | Lickel | 404/84.5 |
| 2011/0097150 | A1 * | 4/2011 | Sinnamon | 404/87 |
| 2011/0217121 | A1 * | 9/2011 | Argento et al. | 404/118 |

* cited by examiner

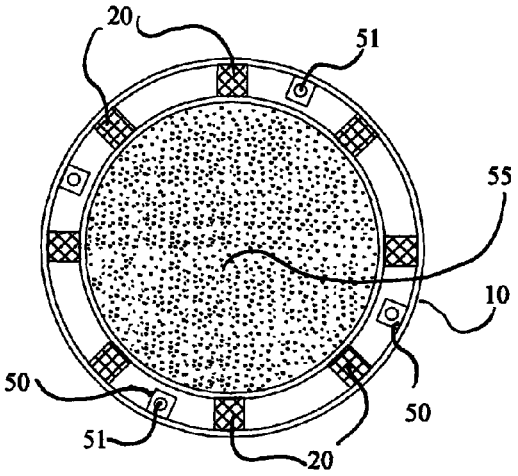
FIGURE 14
FIGURE 15
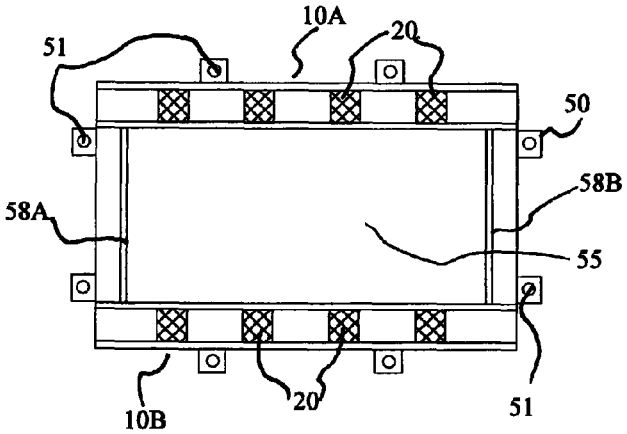
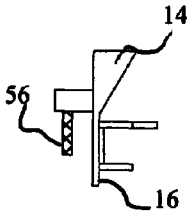
FIGURE 16A
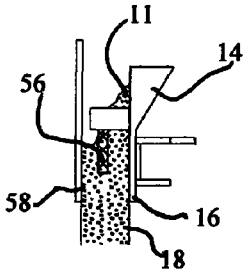
FIGURE 16B
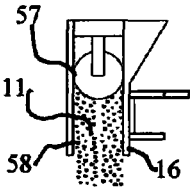
FIGURE 17

VERTICAL VIBRATING SCREED

RELATED APPLICATIONS

This application claims the benefit of the filing date of U.S. Provisional Application Nos. 61/458,934 filed Dec. 3, 2010 and 61/461,436 filed Jan. 18, 2011, both incorporated herein by reference.

BACKGROUND OF THE INVENTION

Prior Art

The following is a tabulation of some prior art that presently appears relevant:

U.S. Patents

| Pat. No. | Kind Code | Issue Date | Patentee |
|---|---|---|---|
| 7,465,121 | B1 | Dec. 16, 2008 | Hendricks et al. |
| 7,156,577 | B1 | Jan. 02, 2007 | Rozinski |
| 7,004,737 | B2 | Feb. 28, 2006 | Russell |
| 6,976,805 | B2 | Dec. 20, 2005 | Quenzi et al. |
| 6,926,851 | B2 | Aug. 09, 2005 | Colavito et al. |
| 6,770,228 | B2 | Aug. 03, 2004 | Rock |
| 6,223,384 | B1 | May 01, 2001 | Kuhlen |
| 6,013,972 | | Jan. 11, 2000 | Face, Jr. et al. |
| 5,997,270 | | Dec. 07, 1999 | LaBonte |
| 5,857,803 | | Jan. 12, 1999 | Davis et al. |
| 5,616,291 | | Apr. 01, 1997 | Belarde |
| 5,554,392 | | Sep. 10, 1996 | Gray |
| 5,533,888 | | Jul. 09, 1996 | Belarde |
| 5,527,129 | | Jun. 18, 1996 | McKinnon |
| 5,198,235 | | Mar. 30, 1993 | Reichstein et al. |
| 4,653,957 | | Mar. 31, 1987 | Smith et al. |
| 4,320,075 | | Mar. 16, 1982 | Nielson |
| 4,253,810 | | Mar. 03, 1981 | Bezhanov et al. |
| 4,152,382 | | May 01, 1979 | Catenacci |
| 4,128,610 | | Dec. 05, 1978 | Ahlgren |
| 4,084,928 | | Apr. 18, 1978 | Petersik |
| 4,076,778 | | Feb. 28, 1978 | Whitting |
| 4,076,474 | | Feb. 28, 1978 | Catenacci |
| 4,014,633 | | Mar. 29, 1977 | Goughnour |
| 3,957,405 | | May 18, 1976 | Goughnour |
| 3,936,211 | | Feb. 03, 1976 | Miller et al. |
| 3,510,098 | | May 05, 1970 | Fox |
| 3,509,606 | | May 05, 1970 | Fisher |
| 3,497,579 | | Feb. 24, 1970 | Barron |
| 3,039,164 | | Jun. 19, 1962 | Kemeny et al. |
| 2,346,378 | | Apr. 11, 1944 | Jackson |
| 2,253,730 | | Aug. 26, 1941 | Seailles |
| 2,187,223 | | Jan. 16, 1940 | Cory |

U.S. Patent Application Publications

| Publication No. | Kind Code | Publ. Date | Applicant |
|---|---|---|---|
| 2010/0139196 | A1 | Jun. 10, 2010 | Healy |
| 2009/0053345 | A1 | Feb. 26, 2009 | Martins et al. |
| 2008/0050177 | A1 | Feb. 28, 2008 | Sager |
| 2007/0082080 | A1 | Apr. 12, 2007 | Sandqvist |
| 2005/0036837 | A1 | Feb. 17, 2005 | Marshall |

This invention discloses a method of casting concrete walls, columns and other vertical or sloped structures using a vertically oriented vibrating screed and utilization of the thixotropic properties of wet concrete. The vertical screed is a simple, inexpensive and highly flexible apparatus that may be used for a wide variety of applications and may be either a hand held or mechanically controlled device. By using a highly thixotropic cementicious material such as concrete, the vertical screed is able to place concrete and other cementicious materials in a vertical plane much like concrete is placed with vibrating screeds in the horizontal plane.

Vibratory screeds are well known in the art for spreading wet concrete in horizontal casting applications such as roads, sidewalks and floor slabs. These screeds are simple devices that have a vibrator attached to a metal plate or tube and are moved horizontally to spread, level and consolidate the wet concrete placed ahead of their forward movement. These screeds are inexpensive, easy to use and come in a variety of sizes and features. However, such a simple vibrating screed does not exist for casting concrete vertically to build a vertical structure.

Walls and other vertical concrete structures have been built with cast-in-place concrete either by using forms, into which wet concrete is cast, or by shotcrete—the spraying a concrete mix against a form backboard. In the case of forms, the wet concrete is placed, vibrated and left to set or harden inside the forms. In some forming systems the forms permanently remain in place while in other systems the forms are removed at some point after the concrete has sufficiently hardened. In those systems where the forms are removed, some are removed after a day or two while in other systems the forms are moved in a matter of minutes which is a process known as slip forming. In most slip forming processes and in the shotcrete process the finished concrete is exposed well before it reaches its final set.

In the slip forming process forms are moved by being "slipped" along the freshly placed concrete and thereby exposing the concrete within a matter of minutes or hours after being cast. This may be done in either a horizontal or a vertical movement and the prior art discloses either one or the other but not the flexibility to switch from a horizontal to vertical movement as may be desirable from application to application. In addition, the slip form prior art are also highly inflexible apart from casting a specific type of wall within limited dimensions and shapes. For example an apparatus capable of casting a tapered road barrier wall is incapable of casting a tall and thin building wall.

There is no prior art that is capable of casting a wide variety of vertical structures ranging from thin walls to thick columns and irregular shapes. There is no prior art that can vary the thickness of the cementicious material applied to these structures and ranging from a thin coating to a reinforced concrete thickness of 24" or more. Moreover there is no slip form prior art flexible enough to cast composite structures such as insulated concrete walls and that can also be used to apply concrete to thin shelled, ferrocement structures. Nor is there any prior art slip forming apparatuses with the flexibility to cast from only one-side or from multiple sides or in a sloped position in order to cast vertical walls, columns and sloped roofs.

The prior art slip forming systems for casting building walls are large, expensive and cumbersome forming machines or systems with a multitude of jacks or winches. Most of the prior art requires two or more forms that must be used in unison and further require either applying pressure to the concrete, utilizing accelerators for rapid hardening or keeping the forms in place for a short period of time to allow the concrete to set. In addition, the prior art that discloses slip forms for road barrier walls depend, primarily upon casting short and stocky or taller tapered walls and it is the wall's profile that enables the wet concrete to retain its shape as the slip form passes by.

None of the prior art discloses a reliance upon the thixotropic properties of no-slump concrete as a basis to the concrete retaining its shape as the slip form passes by. And none of the prior art can be downsized to an inexpensive hand held apparatus that can perform the same functions as a much larger mechanically operated apparatus.

The prior art slip forms that are based upon a one-sided forming system either require the cementicious material to sufficiently hardened before the forms are moved or uses the shotcrete process. The shotcrete process of placing concrete uses air pressure and a gun or nozzle to impinge wet concrete in thin layers against a vertical form/backstop with successive layers built-up to the desired thickness. The thin layers and air pressure dissipates most of the hydrostatic pressure that is ordinarily created with vertical stacking of wet concrete. The result is minimal sagging and the ability to hand trowel it to a smooth, vertical surface within minutes after the final layer has been applied. Shotcrete is a more expensive system due to the material waste caused by the rebounding sprayed concrete, safety precautions related to a spraying operation and the hand labor required to work the sprayed concrete into an acceptable finish.

While there is no prior art of vertical vibrating screeds, there are vibrating trowels that are used to finish either vertically or horizontally placed concrete. The vibrating trowels do not place the concrete or vibrate the full depth of the concrete, but rather vibrate the surface area to produce a better finish and appearance.

SUMMARY OF INVENTION

The present invention is a simple, low cost and highly flexible alternative to slip forms and shotcrete. It can be used to cast any type, size and shape of solid or composite vertical or sloped concrete structure. In its most simplified design, the present invention is a small, inexpensive handheld vibrating screed that places, consolidates, shapes and finishes concrete or other cementicious material in a vertical manner so as to construct building walls or to apply a thin coating to a wall or other vertically oriented structure. In its more elaborate design, the present invention does these same activities, although in a larger and highly mechanized apparatus. Such a large mechanical device can place hundreds of square feet of area per hour to build walls, columns and other vertical structures or place concrete on roofs, embankments and other sloped structures.

The present invention is able to screed concrete vertically while being vibrated because it utilizes the thixotropy of low-slump concrete. Thixotropy is a material property that describes a material as being in a solid state when at rest and becoming liquefied while being agitated. Thixotropy is a property of freshly mixed zero-slump, no-slump or low-slump concrete in that this type of concrete is in a solid state, similar to moist, clumpy dirt, when at rest and becomes liquefied when vibrated. Therefore, concrete and other cementicious materials with a zero-slump, no-slump or low-slump are said to be highly thixotropic. Relative to the present invention, this material property enables the no-slump or low slump concrete to be consolidated, spread, shaped and molded in a liquefied state through vibration by the screed and then to immediately revert to a solid state once the vibration ceases as the moving screed passes by. When in a solid state, the no-slump, concrete exerts no hydrostatic pressure which enables it to hold its shape while other wet concrete is being stacked vertically above it, no matter what the wall height or thickness.

An important aspect of this invention is that it is the only concrete placing machine that enables concrete to be inexpensively placed in a vertical plane much like concrete is inexpensively placed in a horizontal plane. In both applications, a vibrating screed liquefies, consolidates, spreads and levels the fresh concrete against a stay-in-place or removable form. The primary difference is at the concrete used in the vertical application must have a high degree of thixotropic behavior that is found in low or no-slump concrete whereas the concrete used in horizontal castings typically uses a much higher slump of concrete. This difference in the concrete slump requires certain modifications to the vibration to ensure the no-slump concrete is adequately consolidated, shaped and finished.

In one embodiment of this invention, the vibrating screed is vertically oriented and is used to place highly thixotropic concrete, in a vertical plane to cast walls, columns and other vertical structures in a wide variety of thicknesses, shapes and sizes.

In another embodiment of this invention the vertical screed is a simple, inexpensive and highly flexible apparatus that can be configured for use as either a small hand held device or a larger, mechanically operated apparatus capable of placing several hundred square feet of area per hour.

In another embodiment of this invention, the vertical screed may be mounted on tracks or a mechanical arm and used to stabilize and move the screed in a vertical, horizontal or diagonal direction.

In another embodiment of this invention, sensors and other mechanical or manual means are used to guide the vertical screed in a predetermined path and apply the appropriate thickness of material needed for a particular application.

In another embodiment of this invention the vertical screed is used to place concrete to cast a sloped structure such as a sloped roof or embankment.

In another embodiment of this invention, the vertical screed has a degree of flexibility that it can be used to place concrete on one side of a vertical structure such as a composite wall or on multiple sides of a vertical structure such as a column.

In another embodiment of this invention a mesh is used to support the cementicious material and the use of several layers of wire mesh enables the construction of thin walled ferrocement structures by using this invention.

In another embodiment of this invention additives may be added prior to or during the placement of the cementicious material to achieve a variety of desired effects.

Other objects, advantages and features of my invention will be self evident to those skilled in the art as more thoroughly described below.

BRIEF DESCRIPTION OF THE DRAWINGS

FIG. 14 is a plan view showing the vertical vibrating screed of this invention used to form a circular column.

FIG. 15 is a plan view of two vertical vibrating screeds and two slip forms arranged in a rectangular fashion to cast a column.

FIG. 16A is a section side view showing an internal concrete vibrator mounted on a frame with a hopper and slip form.

FIG. 16B is a section side view showing concrete being vibrated by an internal vibrator.

FIG. 17 is a section side view showing a roller compactor being used to liquefy, consolidate and spread the concrete.

DETAILED DESCRIPTION ACCORDING TO THE EMBODIMENTS OF THE PRESENT INVENTION

The present invention discloses a method of casting concrete walls, columns and other vertical structures or sloped structures such as roofs, by use of a vertically oriented screed and utilization of the thixotropic properties of wet concrete. Freshly mixed concrete and other cementicious materials that have a zero-slump, no-slump or low-slump all contain a high degree of thixotropy and are thereby highly thixotropic. Throughout the following detailed description the term low-slump concrete shall include zero-slump and no-slump concrete and shall also refer to other highly thixotropic cementicious materials. In addition, the term vertical shall include anything sloped so that a vertical structure includes a sloped structure such as a sloped roof and vertically oriented includes a slope.

Figure 1:
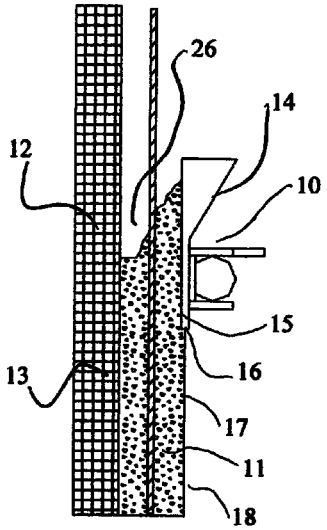
FIG. 1 is a section view of a hand held vertical vibrating screed of this invention shown placing concrete on a vertical structure.

FIG. 1 shows the vertical screed 10 placing low-slump concrete 11 into a vertically oriented casting area 26 bordered by a vertically oriented screed face 15 of the vertical screed 10 on the open side and a vertically oriented form 12 positioned a predetermined space apart from the vertical screed 10 on the opposite side. The concrete 11 is cast into a hopper 14 that is generally above the screed face 15 and is used to feed concrete 11 into the casting area 26. The hopper 14 has one or more openings to receive the concrete 11 and one or more openings to feed the concrete 11 into the casting area 26. The hopper 14 may also have one or more movable sides not shown) to enable an adjustable width to accommodate different pass widths.

As the vertical screed 10 is moved, the concrete 11 falls from the hopper 14 into the casting area 26 and against the form 12 that provides a backstop, and fills the casting area 26 between the screed face 15 and the form 12. Once the low-slump concrete 11 is in the casting area 26, it is vibrated by a vibrator 20 attached to the backside of the screed face 15 as a means for liquefying, consolidating and spreading the concrete 11 to fill the casting area 26 between the screed face 15 and the form 12.

The vertical screed 10, with its screed face 15 and vibrator 20 acts to liquefy, consolidate and spread the low-slump concrete 11 against the form 12 and around the steel reinforcement 19 to produce a solid concrete structure with an outside face 17 of a concrete wall 18. Immediately below the vertical screed 10 is a slip-form 16 that extends and finishes the forming function of the screed face 15. The slip form 16 is in the same plane as the screed face 15 and does not vibrate or has minimal vibrations so as to allow the recently cast low-slump concrete 11 to revert to its solid state while retaining the shape produced by the screed face 15. The slip form 16 provides the concrete 11 a transition from its liquefied state, as caused by the intense vibrations on the concrete 11 produced by the screed face 15, to its exposed, unsupported and finished solid state. The slip form 16 also provides the desired finish to the outside face 17 and may be directly or indirectly attached to the vertical screed 10 or it may be a separate device that trails the vertical screed 10.

One embodiment of the invention is to utilize the thixotropic properties of low-slump concrete. Thixotropy is a material property that describes a material that is in a solid state when at rest and a liquid state while being agitated. The thixotropic property of freshly mixed low-slump concrete is such that it is in a solid state after mixing, liquefies during vibration and immediately reverts back to a solid state when the vibration ceases. Specifically, upon mixing and during placement, the low-slump concrete is similar to moist clumpy dirt and, as it is vibrated by the screed, it is liquefied into a cookie dough-like material that flows and fills the contained space. When vibration ceases, the concrete immediately reverts back to its solid state, which is now a consolidated, shaped and solid structure. In addition, the low-slump concrete exerts little or no hydrostatic pressure when in its solid state which enables it to hold its post-vibration shape despite additional wet concrete stacked on top of it. Additives may be added to the concrete and/or heat, pressure or other mechanical means may by used by the vertical screed 10 or form 12 to induce an even faster set time.

Figure 2:
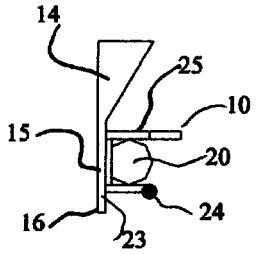
FIG. 2 is a section view of the hand held vertical vibrating screed of this invention.

FIG. 2 shows a hand held configuration of the invention which is a vertical screed 10 consisting of a generally rectangular, flat surfaced screed face 15 positioned perpendicular to the ground and parallel to the face of the wall or column to be cast with cementicious material. The screed face 15 has a vibrator 20 or similar mechanical device attached to it's backside so that it will vibrate or otherwise cause motions to the screed face 15 that can be transmitted to the concrete 11 as it comes into contact with the screed face 15. The vibrator 20 may be any type of mechanical device that vibrates, tamps, packs, rolls, spins, oscillates, compresses or otherwise provides a means for liquefying, consolidating and spreading the concrete 11 as it comes into contact with the screed face 15.

In one embodiment the means for liquefying, consolidating and spreading the concrete is caused by directional vibrations extending from the screed face 15 into the adjacent concrete 11 and continuing through the concrete 11 until reaching the form 12 against which the concrete 11 is vibrated. The concrete 11 cast into the casting area 26 is vibrated to liquefy, consolidate and spread only within the casting area 26. There are a variety of directional vibrators that may be attached to the screed face 15 and are well known in the art.

While the entire screed face 15 vibrates, the vibrations may be stronger at some locations and less or even minimal in others. For example, the vibrations at the bottom of the screed face 15 may be minimal so as to facilitate the transition of the concrete from the screed face 15 to the trailing slip form 16 or the slip form 16 may be a non-vibrating or minimally vibrating area of the screed face 15.

In addition the vibrations at the top of the screed face 15 may have a different amplitude or frequency than the vibrations at the bottom of the screed face 15. This could be accomplished by having vertically stacked directional vibrators attached to the screed face 15 (not shown) A frame 25 as shown in FIG. 2 may be used to hold the hopper 14, screed face 15 and slip form 16 together while providing a means for minimizing or eliminating the vibrations to the hopper 14 and/or slip form 16. The minimally or non-vibrating slip form 16 provides a transition of the vibrated concrete immediately above to the formless concrete immediately below.

FIG. 2 also shows the edge barrier 23 which extends perpendicular from the edge of the screed face 15 and slip form 16 a set distance toward the form 12. The edge barrier 23 provides a side form against which the concrete 11 is vibrated so as to facilitate better consolidation and complete spreading of the concrete along the edge of the pass.

Also shown in FIG. 2 is the vibrator 20 attached to a frame 25 that is attached to the back side of the screed face 15 such that the vibrations extend through the frame 25 to the screed face 15. In the hand held configuration, the handle 21 is used as a means for supporting and guiding the vertical screed 10, in a predetermined direction and a predetermined distance from the form 12. An optional laser or other positioning sensor 24 may be attached to the frame 25 and used to as a means for guiding or otherwise assist in achieving both a proper concrete thickness and constructing a straight and plumb or some other type of shaped concrete structure.

Figure 3:
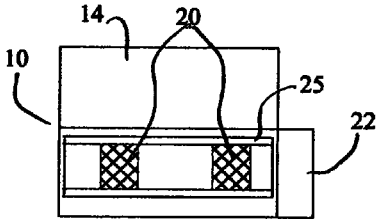
FIG. 3 is a plan view of the backside of the hand held vertical vibrating screed of this invention.
Figure 4:
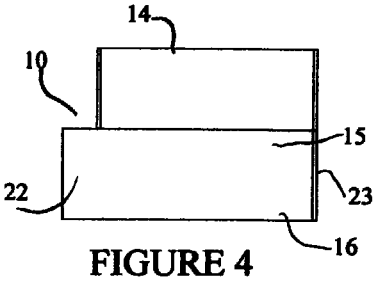
FIG. 4 is a plan view of the front side of the hand held vertical vibrating screed of this invention.

FIG. 3 is the backside of one configuration of the vertical screed 10 and shows two vibrators 20 that are attached to the frame 25 of the vertical screed 10. One or more vibrators 20 are necessary for each vertical screed 10. FIG. 4 shows the front of the vertical screed 10 and the screed face 15 with the slip form 16 at the bottom. In this configuration the hopper 14 is open to the top, to receive concrete 11 and also open to the front to allow the concrete 11 to be gravity fed as a means for casting the concrete into the casting area 26 between the vertical screed 10 and the form 12.

Also shown in FIGS. 3 and 4 is the seam form 22 that is an extension of the screed face 15 and the slip form 16 beyond one side of the hopper 14. This lateral extension consolidates the concrete from the present pass with the adjoining concrete from the previous pass and thereby provides a means for eliminating seams between the two adjacent screed passes to produce a monolithic structure. As the vertical screed 10 makes a successive pass, the seam form 22 overlaps the edge of the concrete 11 placed in the previous pass to vibrate, consolidate and slip form the still plastic concrete with and into the fresh concrete being placed in the present pass and thereby eliminate any seam between the two passes. When the seam form 22 is used, it extends the screed face 15 laterally which causes the casting area 26 to be enlarged.

In another configuration of this invention one or more variable speed vibrators may be used to increase the flexibility of the invention. For example one vibrator of a multi-vibrator screed may be set to produce a high amplitude and/or frequency to vibrate a deeper area of a wall while an adjacent vibrator may be set with lower amplitude and/or frequency to vibrate a much thinner adjacent wall section. In addition, the seam form 22, edge barrier 23, hopper 14 and slip form 16 may be disconnected from the vertical screed 10 to provide it with greater flexibility to place and finish the concrete. For example the vertical screed 10, after disconnecting some or all of the above parts, may be used as a vibrating trowel to work the surface area of the vertical structure or fill concrete into small voids.

Figure 5A:
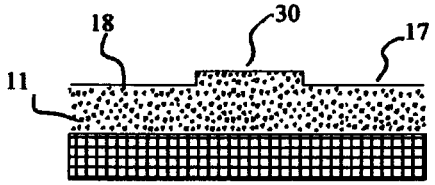
FIG. 5A is a section view showing a rectangular protrusion on the face of a concrete structure as created by the vertical vibrating screed.
Figure 5B:
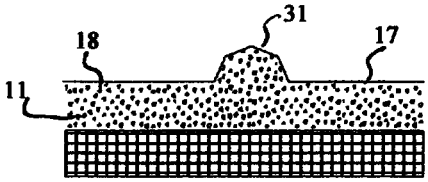
FIG. 5B is a section view showing a curved protrusion on the face of a concrete structure as created by the vertical vibrating screed.
Figure 5C:
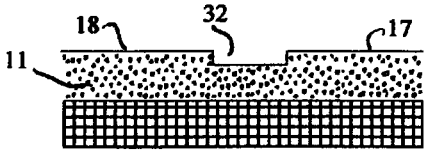
FIG. 5C is a section view showing a indentation on the face of a concrete structure as created by the vertical vibrating screed.

The screed face 15 may have a flat, concave or convex surface or it may have a moving object built into it so as to shape the concrete 11 as the screed face 15 passes by. The screed face 15 may also be three dimensional with curved or rectangular shapes as shown in FIGS. 5A to 5C. In FIG. 5A a rectangular protrusion 30 is shown on the outside face 17 of the wall 18 as created by the vertical screed 10. FIG. 5B shows a curved protrusion 31 and FIG. 5C shows a rectangular indentation 32 both created by the screed face 15 on the outside face 17 of the wall 18. The screed may also provide any type of finished surface including smooth, textured or rough depending upon at least a portion of the screed face 15 and the trailing slip form 16.

To cast a wall, column or similar vertical structure, a vertically oriented backstop is positioned on one side of the casting area 26. The backstop is a surface against which the concrete is cast and vibrated or otherwise liquefied, consolidated and spread by the vertical screed 10 and its vertically oriented screed face 15 positioned opposite the backstop, on the other side of the casting area 26. The backstop may be a form 12 and may be either a stay-in-place or a removable type. For example in FIGS. 6 and 7, the form 12 is an insulation board 13 that will remain in place and permanently bond to the concrete 11 to produce a composite insulated concrete wall 18. In other applications the form 12 may be conventional removable forms well known to the art and adapted to function as one-sided forms.

Figure 7:
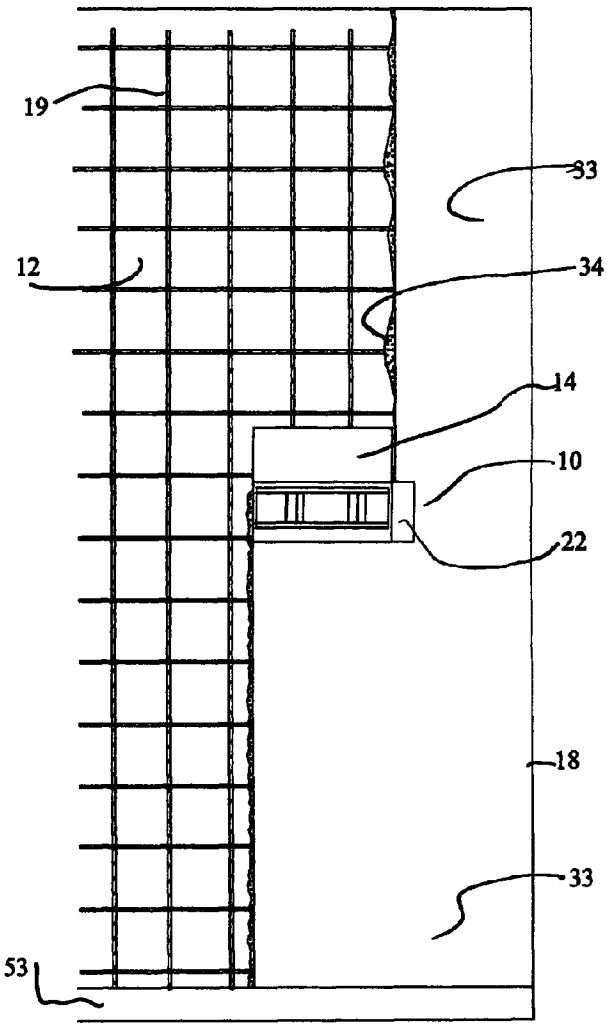
FIG. 7 is a section front view of a wall being cast with the hand held vertical vibrating screed.
Figure 6:
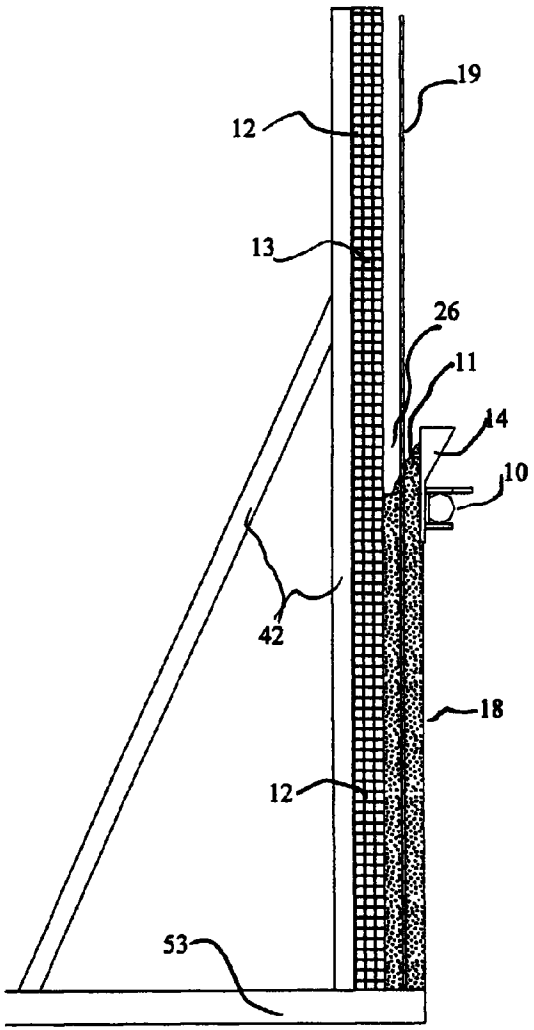
FIG. 6 is a section side view showing the hand held vertical vibrating screed casting concrete against a backstop to cast a vertical structure.

The hand held configuration of the vertical screed 10 is shown in FIGS. 6 and 7 as making a second vertical pass up the wall 18. FIG. 6 is a section side view of a wall being cast with the vertical screed and FIG. 7 is a front view of FIG. 6. In FIG. 7 the first vertical pass 33 has been made up the entire height of the wall 18 and a second, successive vertical pass is in progress with the vertical screed 10 placing the fresh concrete 11 adjacent to the first pass 33. As can be seen in FIG. 7 the unfinished edge 34 from the first pass 33 is being joined together with the concrete 11 of the second pass by the seam form 22 that vibrates, consolidates and slip forms the concrete from both passes. In a like manner, if the screed moves horizontally, a successive horizontal pass is consolidated and finished with the top edge of the prior horizontal pass to produce a seamless monolithic wall slab.

FIGS. 6 and 7 also show the concrete reinforcement 19 which may be welded wire fabric or steel rebar, although any type of reinforcement, including fibers, may be used. Concrete 11 may be fed into the hopper 14 or in front of the vertical screed 10 by any means that can move low slump concrete 11 including a scope, bucket, auger, conveyor and a pump. In addition, the concrete may be spread inside the hopper 14 to achieve a more even distribution by any means including manually, with an auger or with some other mechanical spreading device.

The vertical screed 10 may be used vertically as shown in FIGS. 6 and 7 from the bottom up with a single pass to complete a section of the wall. The vertical screed 10 may be used to dispose a single layer of the cementicious material or it may be used to place multiple layers of the same or different cementicious material in one or more passes. The screed may also be used with different screed faces 15 or trailing slip forms 16 to produce different cementicious surface finishes. The vertical screed 10 may also be used to cast straight, curved or tapered profiles of almost any thickness and can accommodate any type of cementicious reinforcement material.

Figure 8:
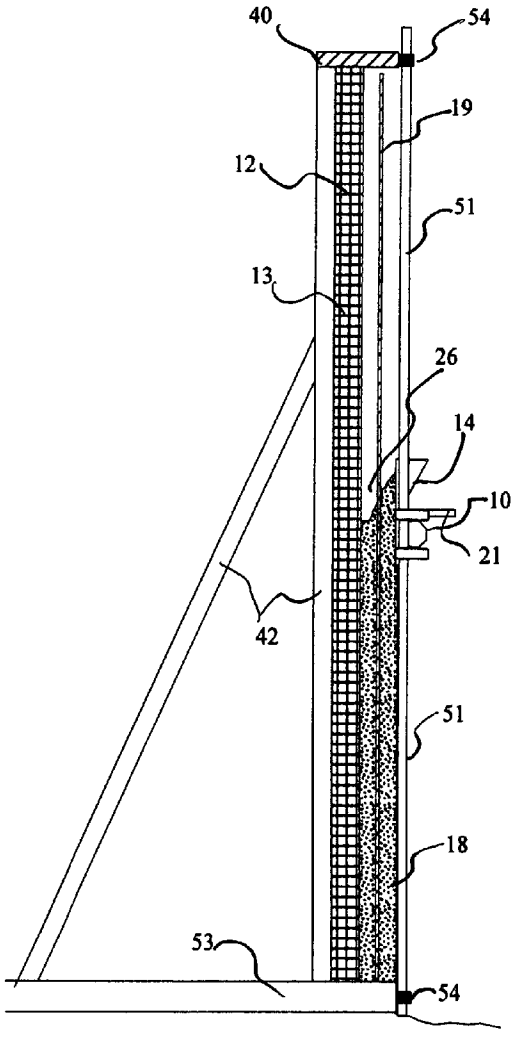
FIG. 8 is a section side view of the vertical vibrating screed mounted on a vertical track.

As a means for supporting and guiding the vertical screed 10 in a predetermined direction while maintaining a predetermined distance from the from 12, it may be hand held or it may be mechanically supported and guided by one or more tracks or other mechanical means including cables, mechanical arms, cylinders and platforms. FIG. 8 shows a vertical track 51 to which the vertical screed 10 is attached. In this configuration there are two tracks 51, one on either side of the vertical screed 10 which slides up and down the tracks 51 by manually guiding the handle 21. Also shown in FIG. 8 the tracks 51 may have a means for attaching to the foundation or slab 53 at the bottom and at the top to a form 40 through mounts 54. These secured mounts 54 or other means for attaching the tracks 51 at the top and the bottom of the concrete structure will ensure a straight and rigid support to the tracks 51 on which the vertical screed 10 is guided.

Figure 9:
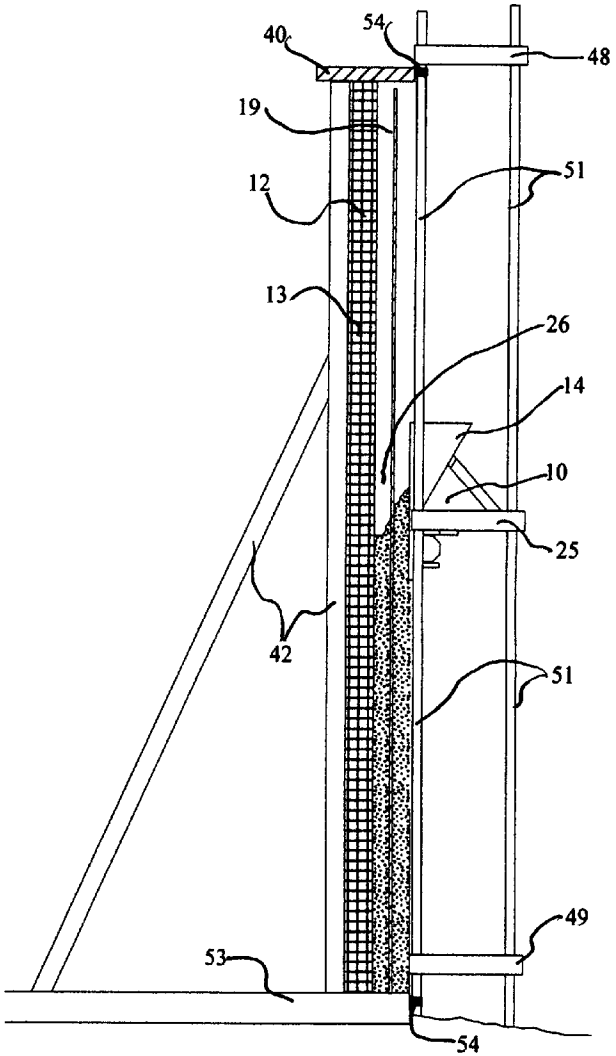
FIG. 9 is a section side view of the vertical vibrating screed mounted on a double vertical track.

FIG. 9 shows another configuration of this invention whereby a four-legged vertical track 51 is used to support and guide the vertical screed 10. A top support frame 48, a bottom support frame 49 and a screed frame 25 are all mounted on two pairs of tracks 51, a pair one each side of the vertical screed 10. The vertical screed 10 assembly slides up and down the vertical tracks 51.

The vertical screed must be guided in terms of both its direction and in maintaining a predetermined distance between the vertical screed and the form. The means for supporting and/or guiding the vertical screed in this manner may be done manually or mechanically with tracks or a mechanical arm and may include the use of a sensor 24 as shown in FIG. 2, a string line, visually and the use of a depth meter.

Figure 10:
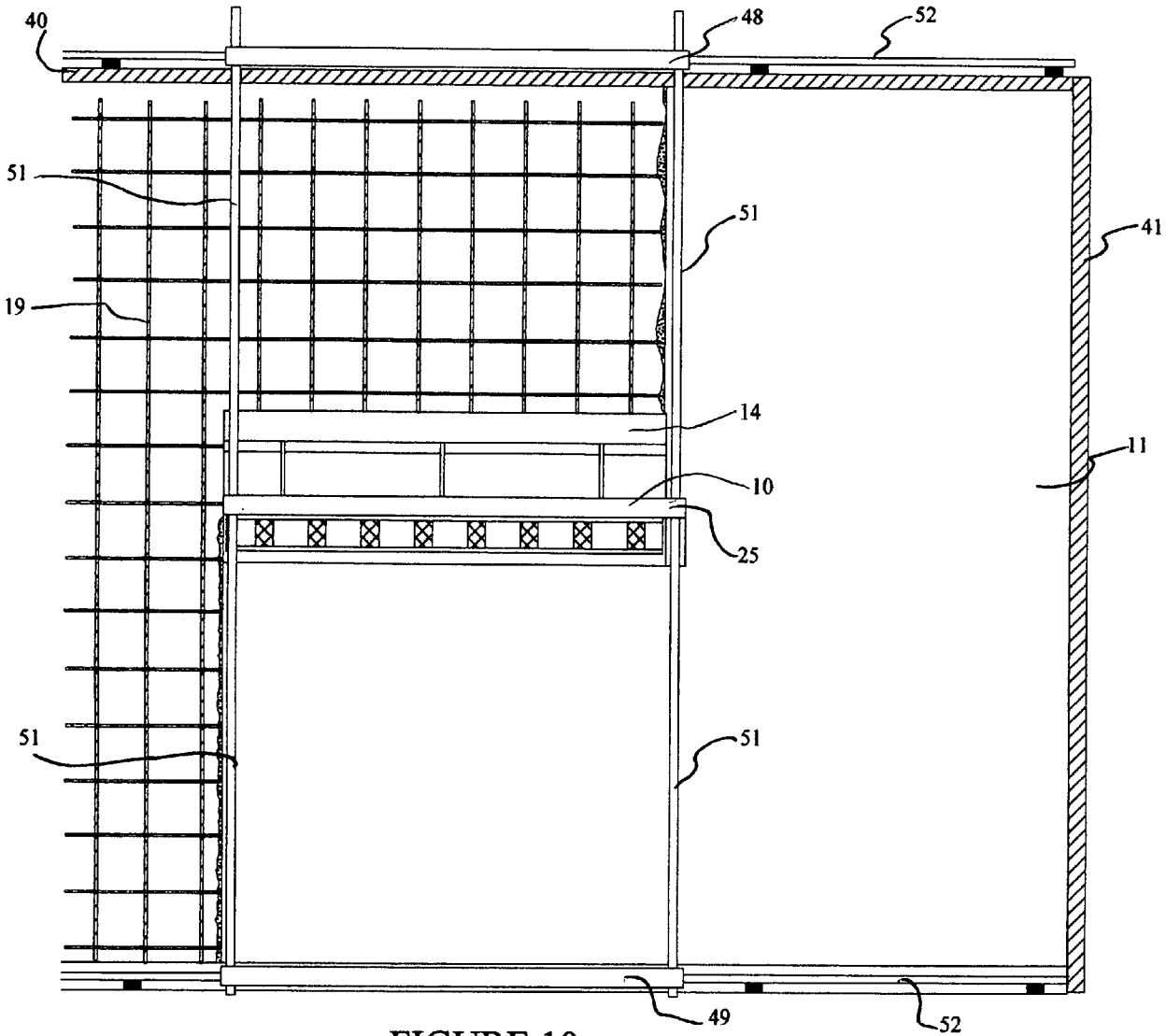
FIG. 10 is a section front view of a larger model version of the vertical vibrating screed shown casting a wall and mounted on vertical and horizontal tracks.

FIG. 10 shows another configuration of this invention with a much larger vertical screed 10 positioned by being attached to vertical support frames. In FIG. 10, the top support frame 48 and the bottom support frame 49 hold the tracks 51 together at the top and bottom while the frame 25 enable the vertical screed 10 to be mounted upon the tracks 51 for vertical movement. The tracks 51 may be of any size and shape and of any material that supports the frame 25, vertical screed 10 and hopper 14, either combined or separate, as it is guided in a predetermined direction along the tracks 51 using various means including manually, winches, cylinders, screw, cogs, crank or other means known to the art. For example an electric winch may be used to pull the vertical screed 10 and hopper 14 up one or more round pole tracks 51. The track drive mechanism may be powered by any number of means known to the art or operated manually.

In another configuration, the vertical screed 10 and hopper 14 may be mounted on one or more tracks 51 and intermittently repositioned to place the concrete 11. For example, instead of placing concrete 11 in a continuous directional movement, the vertical screed 10 and hopper 14 may be held in a predetermined location while the concrete 11 is placed and once that location is fully placed, then the vertical screed 10 and hopper 14 are repositioned to the next location for concrete placement and repeating the process.

The vertical screed 10 apparatus may also have horizontal tracks 52 as shown in FIG. 10 with one or more horizontal tracks 52 at the base and the top of the structure being cast. The top and bottom support frames 48 and 49 respectively, may be mounted on the horizontal tracks 52 to enable fast and accurate horizontal repositioning to support and guide the vertical screed 10 and frame 25 to facilitate the next concrete placement pass. Once a vertical pass is completed, the support frames 48 and 49 are unlocked from the horizontal tracks 52, and the supporting frames 48 and 49 along with the vertical screed 10 and screed frame 25, are slid on the horizontal tracks 52 to the new position, at which location the support frames 48 and 49 are locked or otherwise secured to the track 52 to support and guide the next pass of the vertical screed 10.

To obtain finished and well compacted corners or edges, top forms 40 and edge forms 41 may be placed at the outside and top corners or edges and at the window, door and other openings. FIG. 10 shows a top form 40 and the edge form 41. These optional forms act as a barrier against which the concrete 11 is compacted by the vertical screed 10 to produce straight, plumb and finished corners and edges.

Figure 11:
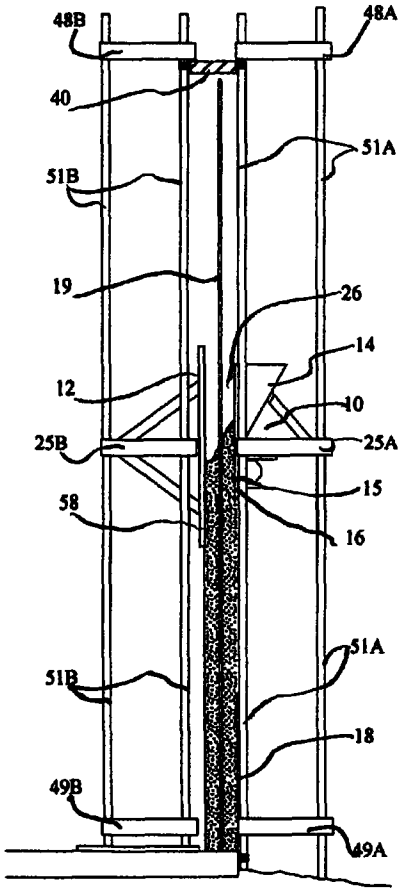
FIG. 11 is a section side view of a vertical vibrating screed casting a vertical structure with a slip form used as the backstop.

The present invention may also be used in a configuration that has a slip form or a second vibrating screed as the backstop instead of the form 12. FIG. 11 shows two sets of tracks 51A and 51B positioned on either side of a wall 18. The tracks 51A and 51B both have top support frames 48A and 48B and bottom support frames 49A and 49B respectfully. The vertical screed 10 and hopper 14 are attached to a frame 25A which is mounted on tracks 51A to support and guide vertical movement of the vertical screed 10. In this configuration a second slip form 58 is attached to frame 25B which is mounted on tracks 51B. This second slip form 58 and frame 25B replaces the form 12 that was used in FIG. 9 and moves vertically in unison with the vertical screed 10 and frame 25A. The concrete 11 is cast into the casting area 26 which is bordered by the screed face 15 on one side and the second slip form 58 on the opposite side. The concrete 11 is liquefied, consolidated and spread by the vertical screed 10 as frames 25A and 25B move vertically upward and each side of the wall 18 is respectively finished by the slip form 16 on one side and the second slip form 58 on the other side.

Frames 25A and 25B may be moved separately or together and manually or mechanically with winches, cylinders, screw, cogs, crank or other means know to the art. For example a single hoist may be used to raise both sides or separate hoists may be used to raise each side. In addition, the two tracks 51A and 51B and their respective support frames may be connected at the top or sides or they may be totally separated as may be desirable in certain situations.

In addition to being a second slip form 58, the backstop of this invention may also be any apparatus that affects the concrete from the second side of the vertical structure. For example the backstop may provide heat to speed the concrete setup and curing or a packing mechanism that packs the concrete from one side while it is vibrated from the other side of the wall or column.

Figure 12:
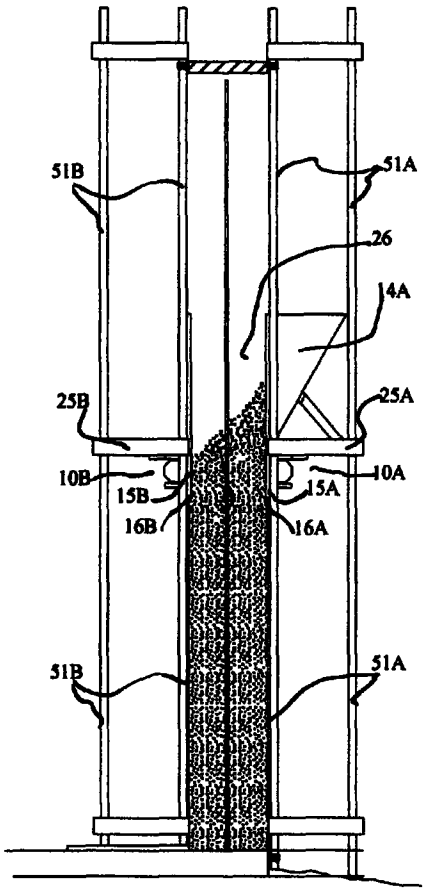
FIG. 12 is a section side view of two vertical vibrating screeds casting a vertical structure.

FIG. 12 shows another configuration where a second vertical screed 10B is used as the backstop. In FIG. 12, the first screed frame 25A has a vertical screed 10A, a hopper 14A and a slip form 16A attached and a second and opposite screed frame 25B has a screed 10B and a slip form 16B attached and may also have an optional hopper attached (not shown). The two screed frames 25A and 25B are mounted on their respective tracks 51A and 51B such that the two vertical screeds 10A and 10B are positioned with their respective screed faces 15A and 15B facing each other and bordering the casting area 26 into which concrete 11 is cast. In this configuration, the concrete 11 is fed into the hopper 14A from which it is cast into the casting area 26 between the two vertical screeds 10A and 10B and the concrete 11 is liquefied, consolidated and spread by the vibration motions from both sides. This configuration permits much thicker concrete walls, columns and other vertical structures since the vibrations from each vertical screed need only to affect about half of the concrete 11 and from only one side of the structure.

The hopper 14A is also optional and as an alternative the concrete 11 could be cast directly into the casting area 26 between the two vibrating screeds 10A and 10B. The purpose of the hopper 14A is to cast the concrete 11 into the casting area 26 and in some applications the width of the casting area may be sufficiently large to eliminate the need for a hopper.

Figure 13:
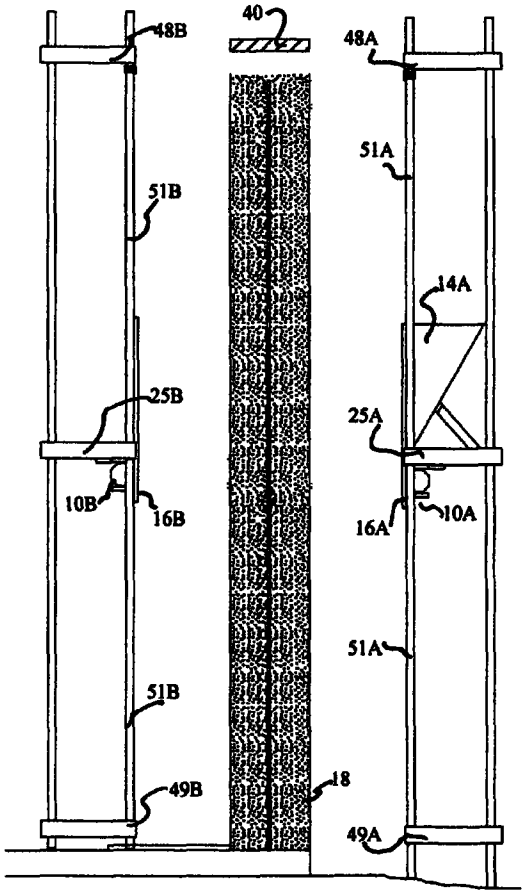
FIG. 13 is a section side view showing a concrete structure after the two vertical vibrating screeds have finished casting concrete to build the structure.

FIG. 13 shows a finished wall 18 from FIG. 12 with the vertical tracks 51A and 51B and their respective support frames and vertical screeds moved away from the concrete wall 18. Another embodiment of this invention is that the vertical screed has significant flexibility in both the type of vertical structures it can construct and how the vertical structures are cast. For example, the vertical screed can be positioned on one side of the wall only with some type of insulating foam board 13 positioned on the second side to cast a composite insulated wall as shown in FIG. 1. The vertical screed can also be positioned on two or more sides of a wall or column with the sides all connected to one another to cast a solid concrete structure. Finally, the vertical screed can be positioned independently of the other side(s) with each side positioned separate and apart from the other such as in high walls or columns where the rebar makes it impractical to connect the vertical screed or slip form sides. While FIG. 13 shows the two tracks 51A and 51B separate and apart, the tracks and respective frames could also be connected to each other at the top or sides.

Another embodiment of this invention is its high degree of flexibility in casting a variety of types, sizes and shapes of vertical structures. In addition to straight walls, columns of all shapes and sizes can be cast from the vertical screed of this invention. For example, one or more vertical screeds 10 may be positioned on one or more sides of a column with or without forms 12 set opposite or between the screeds. When done without forms 12, the vertical screeds 10 opposite one another provide another means for providing the backstop. FIG. 14 is a top view of a round column 55 being cast with a single vertical screed 10 that has eight vibrators 20 surrounding the column 55. The vertical screed 10 and the vibrators 20 are supported and guided by a support frame 50 which travels up the vertical tracks 51. The support frame 50 is anchored at the bottom (not shown) to secure the frame and screed in alignment. The invention may also be used to cast unusually shaped columns such as octagons, crosses, etc., whereby the shape of the screed face(s) 15 determines the shape of the column or other vertical or sloped structure.

FIG. 15 shows a top view of the vertical screed 10 used to cast a rectangular shaped column 55. In this configuration two vertical screeds 10A and 10B are positioned opposite each other and two second slip forms 58A and 58B are also positioned opposite each other to comprise the four sides of the rectangular column 55. As the support frame 50 moves up the vertical tracks 51 the concrete (not shown) is vibrated, liquefied, consolidated and spread and a finished rectangular column emerges from the bottom as the vertical screed 10 moves upward.

In all of the above configurations, the concrete vibration was caused by a vibrating screed that is well known in the art as an external vibrator. In another configuration of the invention, the concrete vibrations are caused by an internal vibrator which is also well known in the art. FIG. 16A shows an internal vibrator 56 attached to the hopper 14 that is above a slip form 16. In FIG. 16B, concrete 11 is deposited between slip form 16 and a second slip form 58 and the internal vibrator 56 liquefies, consolidates and spreads the concrete between the slip form 16 and the second slip form 58. As the slip forms travels upward, the exposed finished concrete wall 18 emerges from below.

The internal vibrators 56 may be mounted anywhere on the vertical screed 10 or support frame or on another mechanical apparatus or they may be manually held and used to consolidate the concrete or otherwise work in concert with the slip forms which acts to shape and texture the concrete in this configuration.

In another configuration of the invention, a cylinder 57 is situated above the concrete and used to deposit, consolidate and spread the concrete 11. The cylinder 57 may simply spin or it may also vibrate or otherwise agitate the concrete. The cylinder 57 may also have protrusions that extend into the concrete (not shown). FIG. 17 shows a configuration of a cylinder 57 located between slip form 16 and second slip form 58 and a means by which the cylinder 57 spreads and consolidates the concrete 11.

There are any number of additives that can be used with the concrete and the invention. For example, the additives can be used to lubricate the concrete, as a water reducer or to induce a fast set. The additives may also be added to the concrete mix or injected, sprayed or otherwise applied to the concrete at any time prior to, during or after the vertical screed has placed the concrete.

The vertical screed may be designed such that it performs more than one function as it passes by the concrete. For example the top section of the screed may provide the vibration stage whereby the concrete is liquefied and consolidated. The lower part of the vertical screed or an attachment thereto may provide a second stage such as a mechanical device that packs the concrete and a third part of the screed may act as a slip-form to shape the concrete. Other functions that may be used with the vertical screed include: mixing concrete, placing additives, heating or dehydration and applying concrete finishes.

Figure 18:
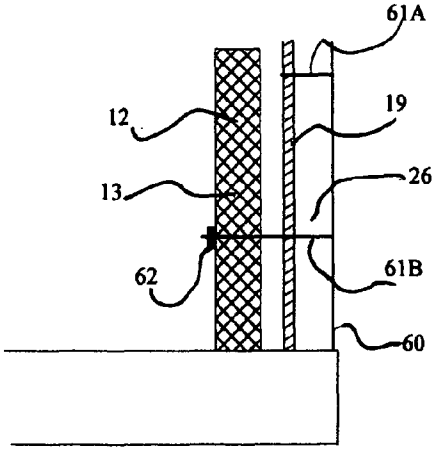
FIG. 18 is a section side view showing a wire mesh retaining structure being attached to the backstop and concrete reinforcement.

In another configuration of this invention, wire or plastic mesh or similar materials may be used to support the wet concrete in its vertical position while curing or to construct ferrocement structures. FIG. 18 shows the wire mesh 60 attached to the rebar steel reinforcement 19 by a means for attachment 61A that restrains the mesh 60 and prevents it from moving away from the rebar steel reinforcement 19. Also shown in FIG. 18 is the mesh 60 attached to the insulation board 13 by a means for attachment 61B that extends through the insulation board 13 to which a clip 62 is attached to prevent the means for attachment 61B from being pulled out.

Figure 19:
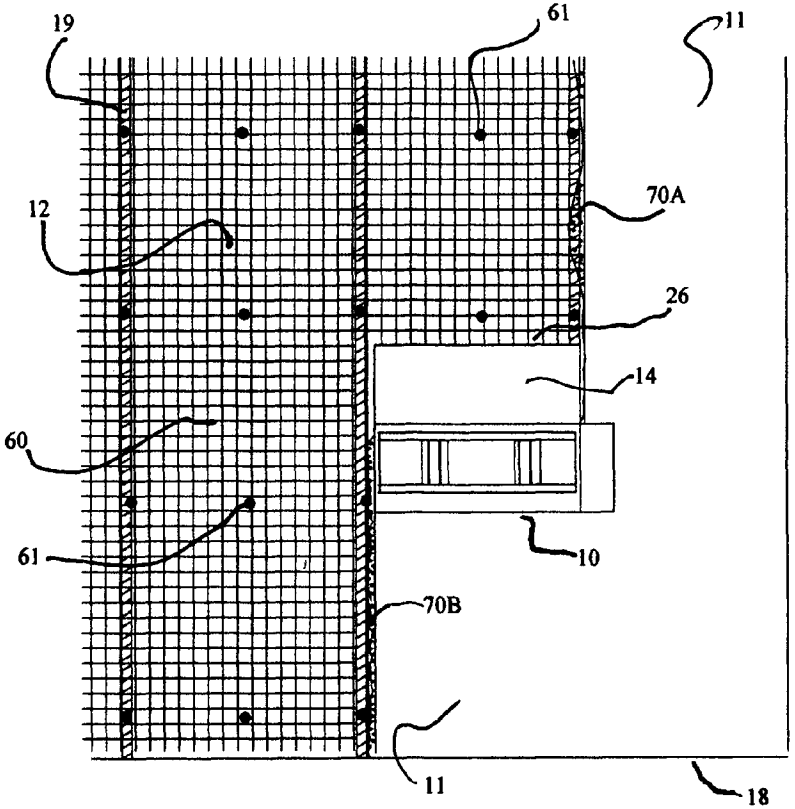
FIG. 19 is a section front view showing a concrete wall being cast with the vertical vibrating screed and a wire mesh retaining structure.

FIG. 19 shows a front view of FIG. 18 with the addition of the vertical screed 10 and concrete 11 that has been placed by the vertical screed 10. In FIG. 19 the mesh 60 has a means for being secured to the rebar 19, or the form 12 and/or the top form and the bottom foundation or other rigid object (not shown). For example mesh 60 may be attached by a means for attachment to the rebar 19 and/or the form 12 such that the mesh 60 is secured away from the form 12 and near the front face of the wall 18 to be cast. As the vertical screed 10 makes it's pass, concrete 11 is fed from the hopper 14 through the opening in the mesh 60 to fill the casting area 26 between the form 12 and the vertical screed 10 and the concrete 11 is liquefied, consolidated and spread embedding the mesh 60. As the vertical screed 10 passes by and only the concrete and the embedded mesh 60 remain, the mesh 60 acts to support the concrete 11 in its final vertical position. The inclusion of the mesh 60 will allow for a higher slump of concrete or provide concrete support and/or reinforcement as may be desired in a particular application.

Additionally, the mesh 60 may be a wire mesh and set in a multitude of layers so as to produce a ferrocement structure when the concrete is applied to it. In this manner, the vertical screed can be used to cast a wire mesh reinforced thin walled concrete structure as is well known in the art.

Figure 20:
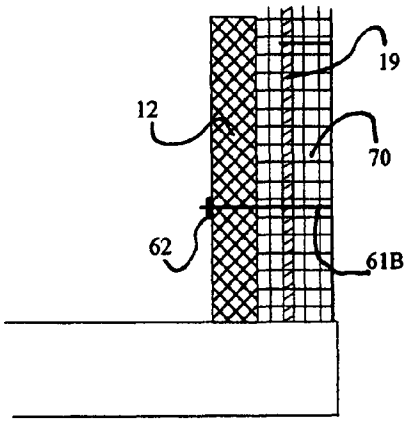
FIG. 20 is a section side view showing a wire mesh retaining structure used to hold the side of the wet concrete is place.

In FIG. 20 is a section side view of an optional side support 70 that restrains the wet concrete (not shown) in a vertical position between the mesh 60 and the form 12 and provides a means for bonding the concrete placed in one pass to the wet concrete placed in a successive pass. The vertical side support 70 is a mesh 60 that supports the side of the concrete 11 during and after placement to prevent it from falling or slumping to the side. From FIG. 19, as the vertical screed 10 passes, wet concrete 11 is vibrated against the concrete 11 being restrained by the first side support 70A which has been partially embedded in concrete 11 from the prior pass. During that same pass, concrete 11 is also vibrated against the second side support 70B that restrains the concrete 11 from falling to the adjacent open area. As the vertical screed 10 makes its successive passes, the new concrete 11 is pushed against the first side support 70A and the exposed concrete from the prior pass that is being restrained by the first side support 70A is re-vibrated, liquefied and consolidated with the new concrete.

Figure 21:
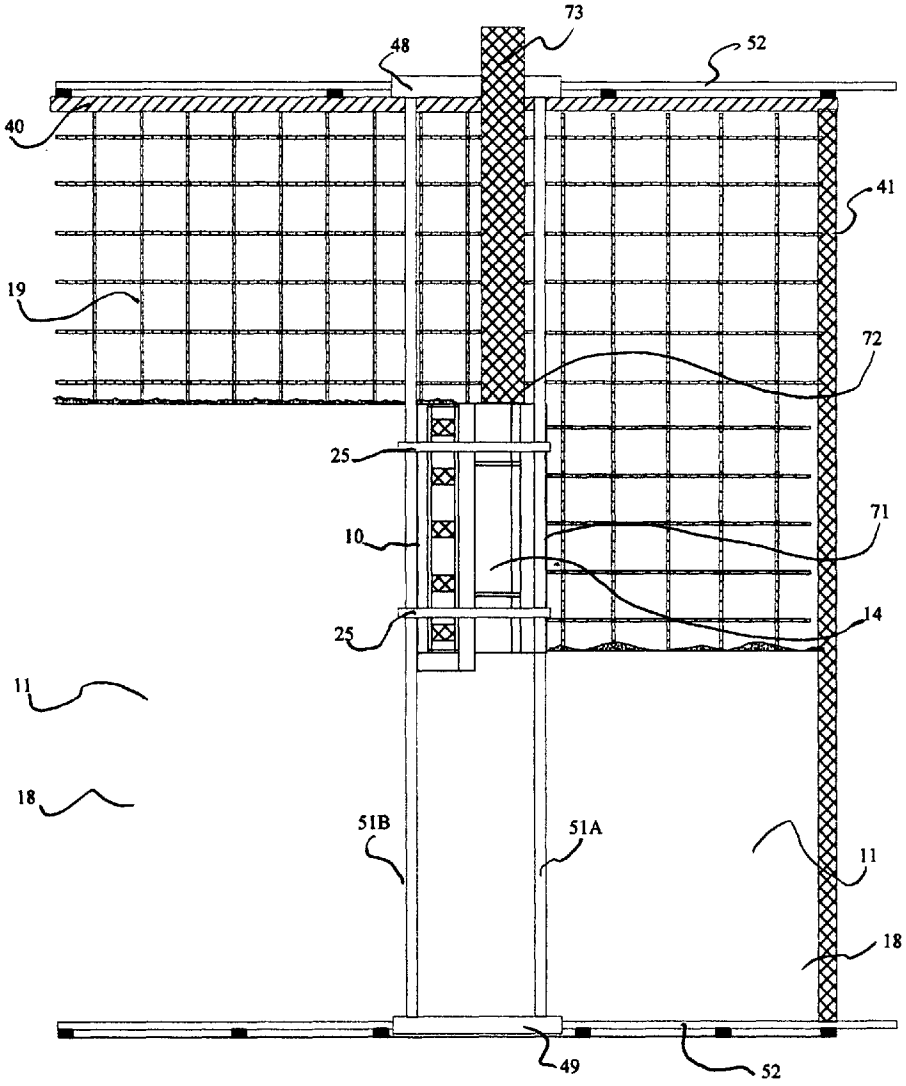
FIG. 21 is a section front view showing a vertical screed placing concrete in the horizontal direction.

FIG. 21 shows a vertical screed 10 placing concrete 11 to cast a reinforced concrete wall 18 through a horizontal movement. The horizontal tracks 52 support the two vertical tracks 51A and 51B which in turn support the top frame 48, the bottom frame 49 and two screed frames 25 as the vertical screed 10 places concrete 11 while moving in a horizontal direction. After each horizontal pass is completed, the screed frames 25 are moved up vertically so as to reposition the vertical screed for the next horizontal pass.

In this configuration the screed face 15 is positioned perpendicular to the ground and parallel to the face of the wall or column being cast with the cementicious material. The only difference is that the vertical screed has been rotated 90 degrees to an upright position so as to more efficiently place the concrete when used in a horizontal direction.

The vertical screeds may be configured to be field modified for use in either the vertical direction or in the horizontal direction. When the same vertical screed used in the vertical direction is modified for use in the horizontal direction, the vertical screed and hopper are rotated 90 degrees. This causes the top and one side of the hopper in the vertical direction to change positions when used in the horizontal direction. Therefore, what used to be the open top of the hopper in the vertical direction is now the side of the hopper in the horizontal direction and must be closed to prevent the concrete from falling out of the hopper. Likewise, what was the closed side of hopper in the vertical direction is now the top of the hopper in the horizontal direction and must be opened to allow concrete to be fed into the hopper.

FIG. 21 shows the vertical screed 10 and the attached hopper 14 rotated 90 degrees and what was the hopper top 71 is now a side and must be closed so as to contain the concrete fed into the hopper 14. In addition, the hopper side 72 has also been rotated 90 degrees to the top of the hopper and therefore must be opened to allow concrete to be fed into the hopper 14. In FIG. 21, the concrete 11 is being fed into the hopper 14 through the hopper side 72 by way of an elephant truck 73, which is well known in the art, and constitutes another means for casting concrete into the casting area.

From the above it is apparent that the vertical screed can also be moved in a diagonal direction as the application may require or otherwise may be desirable.

From the description above, a number of advantages of some embodiments of my vertical screed and method of casting vertical structures with a vertical screed become evident:

(a) The present invention is a simple, low cost and highly flexible alternative to all other methods of casting concrete.

(b) The vertical screed of this invention may be used as a small, inexpensive handheld vibrating screed for use to cast concrete walls.

(c) The vertical screed of this invention offers an inexpensive method of casting larger concrete walls, columns and other vertical or sloped structures with a highly mechanized apparatus that can place hundreds of square feet of area per hour.

(d) The vertical screed of this invention places concrete in a vertical plane using highly thixotropic concrete, to cast walls, columns and other vertical structures in a wide variety of thicknesses, shapes and sizes.

(e) The vertical screed of this invention may be mounted on tracks used to stabilize and move the screed in a vertical and/or horizontal direction.

(f) The vertical screed of this invention may be used to place concrete to cast a sloped structure such as a sloped roof or embankment.

(g) The vertical screed of this invention may be used to cast on one side of a vertical structure such as a composite wall or it may be used on multiple sides of a vertical structure such as a column.

(h) The method of using the vertical screed of this invention may include applying concrete in a vertical plane to several layers of wire mesh which will enable the construction of thin walled ferrocement structures.

Although the description above contains many specifications, these should not be construed as limiting the scope of the embodiments but as merely providing illustrations of some of several embodiments. Thus the scope of the embodiments should be determined by the appended claims and their legal equivalents, rather than by the examples given.

What I claim is:

1. A method for casting a vertical structure from a highly thixotropic cementicious material by:

a. positioning a vertically oriented backstop on at least one side of said vertical structure to be cast, b. positioning a vertically oriented screed a predetermined space apart from said backstop with a screed face facing said backstop, c. casting said material into a hopper attached to said screed and that feeds said material into a casting area between said face and said backstop, d. liquefying, consolidating and spreading, said material in said casting area, e. shaping the outside face of said material with said screed and a trailing slip form, f. eliminating a seam between said material placed in a present pass with said material placed in any previous adjacent pass with a seam form which is a lateral extension to said screed and said slip form and that overlaps said seam, g. supporting and guiding said screed in a predetermined direction while maintaining a predetermined distance from said backstop, h. completing a pass and repeating the above steps for any successive pass, whereby a wall, column or other vertical structure is cast with said material.

2. A method for casting the vertical structure of claim 1 wherein said backstop is a second said screed.

3. A method for casting the vertical structure of claim 1 wherein said backstop is a slip form.

4. A method for casting the vertical structure of claim 1 wherein said backstop permanently remains in place after casting.

5. A method for casting the vertical structure of claim 1 wherein said vertical structure is a sloped structure.

6. A method for casting the vertical structure of claim 1 wherein a mesh is used to support said material.

7. A method for casting the vertical structure of claim 1 wherein said screed is mechanically supported and guided.

8. A method for casting the vertical structure of claim 1 wherein said screed is hand held.

9. A method for casting the vertical structure of claim 1 wherein said screed is supported by a track.

10. A method for casting the vertical structure of claim 1 wherein said screed is supported and guided by a mechanical arm.

11. A vertical screed for placing a highly thixotropic cementicious material against a vertically oriented backstop to cast vertical structures and comprising:

a. a vertically oriented screed face, b. a hopper, positioned above said screed and having a first opening to receive and a second opening to feed said material into a casting area bordered on one side by said screed face, c. one or more mechanical devices attached to said screed face and having means for liquefying, consolidating and spreading said material, d. a slip form trailing said screed and positioned in the same plane as said screed face, e. a seam form laterally extending from said screed and said slip form to overlap a seam between the present pass and a previous adjacent pass, f. a means for supporting and guiding said screed in a predetermined direction while maintaining a predetermined distance from said backstop, whereby said screed places said material against said backstop to cast a vertical structure.

12. The vertical screed of claim 11 wherein said screed is hand held.

13. The vertical screed of claim 11 further including a mechanical arm used to support and guide said screed.

14. The vertical screed of claim 11 wherein said backstop is comprised of a second said screed.

15. The vertical screed of claim 11 wherein said backstop is comprised of a slip form.

16. The vertical screed of claim 11 wherein said vertical structure is sloped.

17. The vertical screed of claim 11 wherein said screed is supported by a track.

18. The vertical screed of claim 11 further including a frame.

19. The vertical screed of claim 11 further including an edge barrier.

* * * * *